United States Patent [19]

Haour et al.

[11] Patent Number: 4,865,876

[45] **Date of Patent: * Sep. 12, 1989**

[54] PROCESS FOR SELECTIVELY FORMING AT LEAST ONE METAL OR ALLOY COATING STRIP ON A SUBSTRATE OF ANOTHER METAL AND INTEGRATED CIRCUIT LEAD FRAME ACHIEVED BY THIS PROCESS

[76] Inventors: Georges Haour, 5, rue Saint Ours, 1205 Geneve; Dag Richter; Peter Boswell, both of 6 bis, rue des Moraines, 1227 Carouge; Willy Wagnieres, 14, Chemin Dami, 1212 Grand-Lancy, all of Switzerland

[ * ] Notice: The portion of the term of this patent subsequent to Jan. 19, 2005 has been disclaimed.

[21] Appl. No.: 94,443

[22] Filed: Sep. 9, 1987

[30] Foreign Application Priority Data

Sep. 10, 1986 [CH] Switzerland ..... 3645/86

[51] Int. Cl.[4] ..... B05D 5/12

[52] U.S. Cl. ..... 427/96; 427/313; 427/320; 427/329; 427/398.2

[58] Field of Search ..... 427/96, 329, 398.2, 427/320, 313; 164/75; 29/527.2

[56] References Cited

U.S. PATENT DOCUMENTS

| | | | |
|---|---|---|---|
| 2,959,829 | 11/1960 | Brennan | 164/474 |
| 3,201,275 | 8/1965 | Alplaus | 427/38 |
| 3,468,695 | 9/1969 | Federman | 427/320 |
| 3,468,770 | 9/1969 | Ghose | 427/329 |
| 4,033,398 | 7/1977 | Laithwaite | 164/268 |
| 4,071,643 | 1/1978 | Pratt | 427/329 |
| 4,288,476 | 9/1981 | Wald | 427/329 |
| 4,310,572 | 1/1982 | Stavros | 427/433 |
| 4,596,207 | 6/1986 | Witt et al. | 164/461 |
| 4,719,962 | 1/1988 | Haour et al. | 164/461 |

FOREIGN PATENT DOCUMENTS

| | | | |
|---|---|---|---|
| 700365 | 12/1964 | Canada | 427/329 |
| 0023472 | 2/1981 | European Pat. Off. . | |
| 860375 | 1/1941 | France . | |
| 923246 | 7/1947 | France . | |
| 1153715 | 3/1958 | France . | |
| 1584626 | 12/1969 | France . | |

*Primary Examiner*—Shrive P. Beck
*Assistant Examiner*—Vi Duong Dang

[57] ABSTRACT

The metal substrate (4) is coated with a coating (6) of another metal of alloy of 4–50 μm thickness by deposition of a molten metal or alloy (5) through a nozzle (2), the melting temperature of this metal or alloy being lower than that of the substrate metal. This coating comports, starting from the substrate, a layer of intermetallic compound of thickness comprised between 0.5 and 4 μm, within a limit not exceeding 40% of the total thickness, the remainder of the coating being formed of the initial coating metal of alloy in a proportion of 97 to 99.5% by weight.

7 Claims, 2 Drawing Sheets

FIG. 2
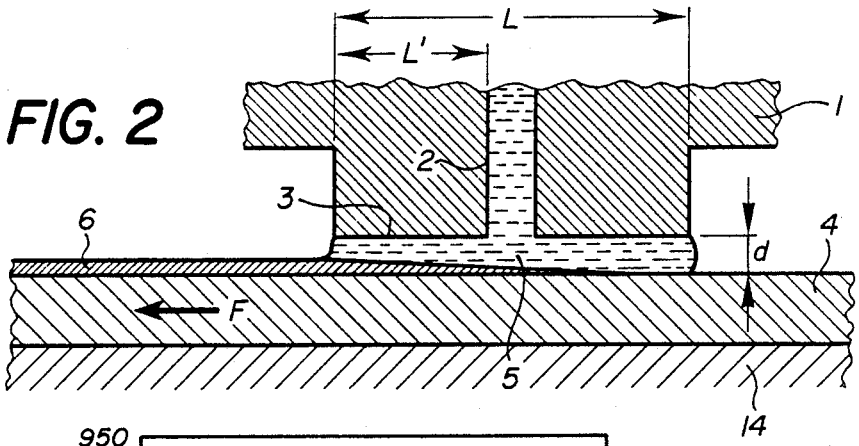
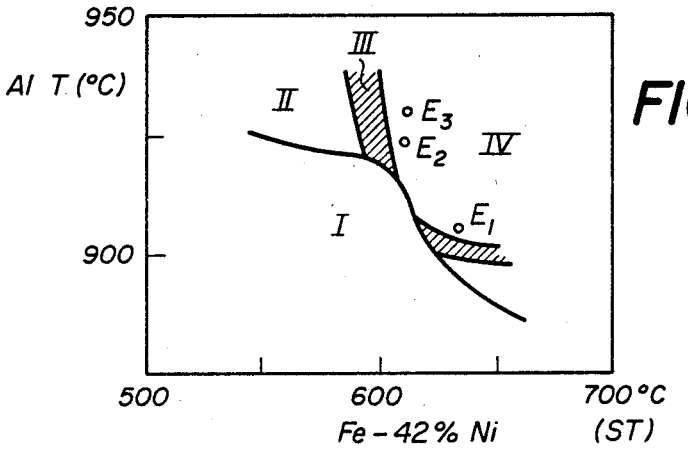
FIG. 3
FIG. 4
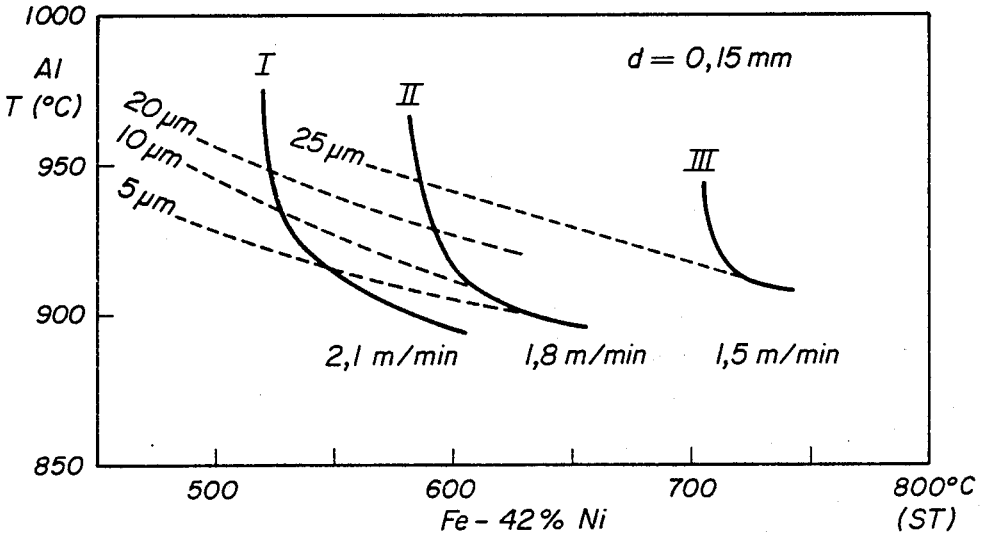

PROCESS FOR SELECTIVELY FORMING AT LEAST ONE METAL OR ALLOY COATING STRIP ON A SUBSTRATE OF ANOTHER METAL AND INTEGRATED CIRCUIT LEAD FRAME ACHIEVED BY THIS PROCESS

The present invention concerns a process for selectively forming at least one metal or alloy coating strip on a substrate made of another metal as well as an integrated circuit lead frame achieved by this process.

Many processes exist for coating metallic substrates with another metal. One can cite, for instance, electrolytic platings, CVD coatings (chemical vapor deposition), PVD coatings (physical vapor deposition), hot co-lamination processes and, finally, coating processes with molten metal, either by dipping the substrate into a bath of molten metal as in the case of zinc galvanization, or by depositing the liquid metal on the substrate.

The electrolytic, CVD and PVD processes are expensive because they are slow, co-lamination is difficult when layers of about 10–40 μm are desired. On the other hand, the coating processes with molten metal or alloy have the disadvantage that the structure of the coating is difficult to control. Thus, when a hot substrate is coated with molten metal, a good wetting of the substrate metal by the molten coating metal is necessary. The wettability is a function of the content period and the temperature at which this contact occurs. During the wetting process, a diffusion of the substrate metal into the coating metal occurs. This diffusion processes is interrupted when an intermetallic compound forms between the metal of the coating and the substrate and when the coating solidifies. In certain applications, namely the electrical applications where coating resistivity is a factor of prime importance, the presence of an alloy resulting from the dissolution of the substrate metal is not tolerable, most of the coating having to be of metal or alloy the purity of which is preferably above 99%. Since good wetting of the substrate by the molten metal is necessary to impart good adhesion and since in the course of this operation the metal of the substrate dissolves partly in the coating metal or alloy, it has not been possible, until now, to use the many techniques involving molten metals or alloys for a large number of applications in the electric and electronic field, for instance for integrated circuit lead frames or for electric contact elements. However, if such techniques were applicable, the productivity of the coating operations for these substrates would be notably increased.

It has been already proposed in FR-A-1.584.626 to embed a steel strip into a layer of aluminium or aluminium alloy by vertically displacing this strip upwards through a vertical slot of a spout connected to a crucible containing molten aluminium which fills the vertical slot, the strip generates capillary forces which balance the forces of gravity on the liquid and is coated with the metal at the onput of this slot. After solidification, a steel strip covered with aluminium is obtained. This is therefore a coating process which provides layers about 20–100 μm thick with the formation at the interface of an intermetallic layer not exceeding 2 μm.

A process of this kind enables to embed a substrate in a metal but does not enable to achieve bank-like, selective coatings of this metal. I is not suitable either to provide coatings of a thickness as low as 4 μm. However, many applications exist, for instance in the field of electronics, where bandlike coatings less than 10 μm thick are required. When the coating thickness is decreased, the flow of liquid metal is reduced in proportion. Thus, in the process of the aforementioned document, wherein the liquid metal is equilibrated by the capillary forces of the upward moving strip, the time of storage of the metal in the spout increases when the rate of flow decreases. This may result, due to the volume of stagnant metal in the spout, in a progressive contamination of the molten metal by the metal of the substrate which can dissolve and migrate into the molten mass as the coating progresses. Consequently, even if the thickness of the intermetallic layer can be limited to less than 2 μm, the purity of the remainder of the coating metal is significantly lowered, i.e. beyond 2% or 3% as compared with its initial purity; therefore certain applications, namely in the electronic field, are not possible.

This shortcoming is particularly significant because, in contrast with the sole application disclosed in FR-A-1.585.626 in which a layer of Al or Al-alloy is coated on a martensite or stainless steel, in the electronic applications, the coating consists of Al or a Pb-Sn alloy deposited on a substrate of Cu/Sn, Fe, Cu, Fe/Ni, etc. It is however known that the metal of such substrates dissolves more rapidly in the coating metal than martensite or stainless steel.

It becomes therefore clear that although techniques for coating a metal on a substrate of another metal have existed for more than 50 years and that such techniques have been used in many applications disclosed in the literature, the coating of substrates with very thin strips, e.g. <20 μm, or <μm, of a metal whose purity is about 99% within 4/5 of the total thickness, has not been achievable until now with the present techniques which are only suitable, as far, in the case of applications with less stringent requirements.

The object of the present invention is to modify the technique of depositing metal strips on substrates with molten metal, in order to meet the most strict criteria of purity, such criteria being presently attainable only the aforementioned techniques whose productivity is markedly lower than that of using liquid metal deposition.

Thus, a first object of the present invention is a process for selectively forming at least one coating strip of metal or alloy on a substrate of another metal whose melting point is above that of the coating metal, the thickness of the strip being in the range of 4–50 μm. This process is disclosed in claim 1. Another object of the invention is an integrated circuit lead frame produced by this process. The lead frames realized in the Examples described in International application No PCT/CH86/00026 are excluded from the scope of claim 1 as specified therein.

The advantages of this process mainly reside in an enhanced productivity as compared with the prior art process. As will be seen from the Examples hereafter, the process enables to exercise excellent control on the nature of the deposit metal, whatever the kind of the substrate metal or the kind of the coating metal or alloy. The metal strips thus produced all have, above an intermetallic layer portion of limited thickness, a portion of the coating metal or alloy the purity of which is substantially equivalent to that of the initially used coating metal or alloy. Moreover, the cross-section of the deposited metal strip is rectangular and constant, and its width is even.

An advantage of this invention is to provide metal substrates coated with molten metal or alloy while avoiding that the substrate metal diffuses into the coating metal to an extent such that the physical properties of this coating metal be detrimentally affected and would become unsuitable for the applications requiring high purity metals. Hence, it will be possible to provide, on conductive substrates, strips for connecting integrated circuits of a thickness about 10 μm and of which the major part is constituted by the coating metal better than 98% pure.

The annexed drawing illustrates schematically and exemplifies the main constituents of a set-up for the production of the metal substrate which is an object of the invention; diagrams illustrating the operational parameters of this set-up are also provided.

FIG. 2 is an enlarged schematized side view of a portion of the installation of FIG. 1 providing parameters illustrating the carrying out of the process.

FIG. 3 and 4 illustrate diagramatically various operating parameters.

Figure 1:
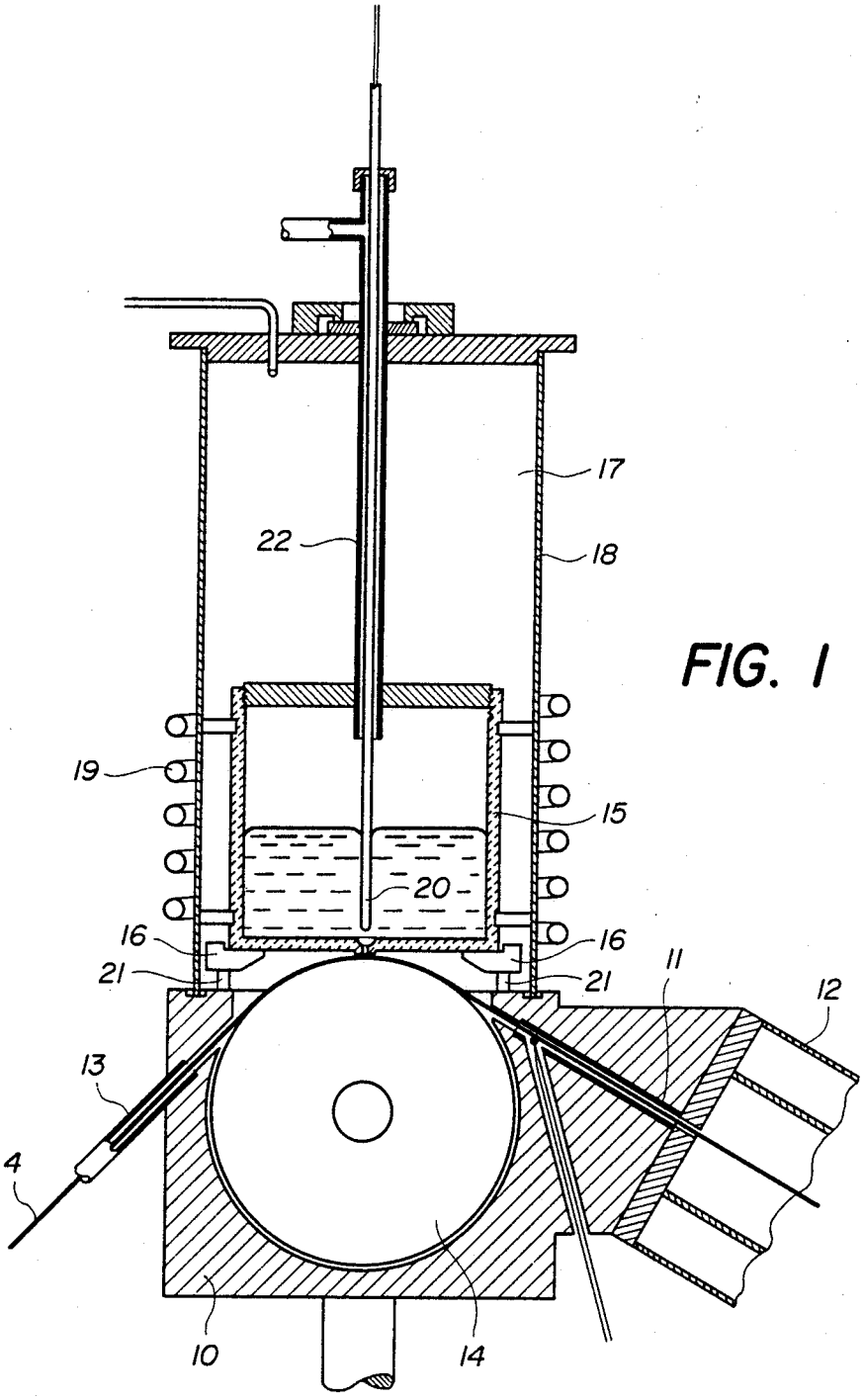
FIG. 1 is a general elevation view of the coating installation.

The installation represented on FIG. 1 comports a frame structure 10 comprising an input duct 11 for the strip to be coated at the outset of a pre-heating enclosure 12, an output duct 13 in thermal relation with a water cooling circuit (not represented), a graphite cylinder 14 rotatively mounted on the frame structure and water-cooled (by a circuit which is not represented). A crucible 15 rests on a supporting ceramic ring 16 positioned by adjustable screws 21. This crucible is retained in a closed enclosure 17 whose side wall is made of a quartz tube 18 which is heated by a high frequency coil 19 surrounding the quartz tube 18. The enclosure 17 is supplied with a neutral blanket gas, e.g. 10% $H_2/N_2$. A temperature gauge 20 is placed in crucible 15 to measure the temperature of the molten metal therein; this gauge is inserted through a tube 22 which is connected to the neutral gas source, this gas providing a dynamic pressure in the crucible which supplements the static pressure provided by the molten metal in the crucible.

FIG. 2 shows a nozzle 1 comprising a liquid metal feed pipe 2 connected to crucible 15 (FIG. 1). This nozzle is terminated by lips 3 which protrude from the bottom of crucible on both sides of pipe 2 in parallel relation with the direction of displacement of the strip 4 to be coated. The liquid metal 5 flowing from feed pipe 2 and nozzle 1 distributes itself by capillary effect between the substrate 4 and the lips 3 of the nozzle 1. As the substrate moves away in the direction of the arrow F, a portion of the liquid metal solidifies by contact with the substrate and is drawn therewith to provide the coating 6.

A first condition to be respected is a perfect adhesion of the coating on substrate 4. Thus the substrate is heated to a temperature below its melting temperature, the latter being above the melting temperature of the coating metal 6.

For ensuring adhesion, a perfect wetting of the substrate is to be achieved; this can only happen when the time of contact of the substrate and the molten metal is sufficient before solidification of the coating 6 occurs. During this wetting stage of the substrate 4 by the liquid metal 5, the substrate metal diffuses into the liquid coating metal and forms intermetallic compounds which may spoil the physical properties of the coating metal. In the prior art, the extent of diffusion of the substrate metal is so great that the intermetallic compound(s) constitute(s) the major portion of the coating, the remainder thereof comprising the substrate metal in alloyed form; consequently the metal in the coating is not in a substantially pure state or, at least, it is not sufficiently pure for many intended applications.

To cope with this difficulty without affecting the adhesion of the coating on the substrate, one should reach a combination of conditions which, when the substrate 4 is effectively wet by the molten metal, promote a very rapid solidification. The solidification rate should be faster than the rate of diffusion of the substrate metal into the liquid metal deposited on the surface; this is because the diffusion should be stopped at a distance as close as possible from the substrate, in order to achieve a proportion, as large as possible in the coating 6, of a metal substantially as pure as the initial metal; and also to achieve an intermetallic compound layer as thin as possible. Evidently, many parameters are involved. These parameters relate on one hand to the physical construction dimension of the set-up and, on the other hand, to the operational conditions and, finally, to the rate of diffusion of the substrate metal into the coating metal and the phase diagram of the metals used. This is one reason why, although the process leading to the formation of a coating of a metal as pure as possible (or a given alloy) can be explained by the above considerations relative to the rates of migration and solidification, it is difficult to determine a single governing rule, the latter depending not only on the operational conditions but also on the tendency of the metals involved to form one or more intermetallic compounds. Thus, in some cases, the metals involved have more or less the faculty of forming one or several intermetallic compounds, which results in a more or less thick layer of this or these compounds in the coating. One has however found, after a series of experiments achieved with various metals and alloys to form coatings on substrates made of other metals and alloys whose melting temperature is above that of the coating metals, that it is possible to obtain 5–50 μm thick coatings without an intermetallic compound layer thicker than 4 μm, within a limit not exceeding 50% of the total thickness of the coating, and the metal of which is at least 97% pure in the remaining part of the coating. The Examples described hereafter show that, in many cases, the aforementioned limits can be substantially reduced and that it is possible to obtain coatings applicable to exacting technologies such as integrated circuit lead frames where the purity level of the coating metal and the intermetallic layer thickness must obey very tight specifications.

All the recited examples have been carried out with the same installation; the lips 3 of the nozzle 1 have a total length L of 2.5–3.5 mm, the feed-duct 2 of the nozzle has a rectangular cross-section the size of which corresponds to the width of the desired coating. The distance d between the lips 3 of the nozzle 1 and the substrate 4 is rather important. It cannot exceed 0.5 mm and is generally about 0.15 mm, or less, whatever the coating thickness. The length L of the lips 3 on both sides of duct 2 should be at least about 2 mm; the value of L' can vary from 0.5 to 5 mm. The conduit 2 can be decentered backwards relatively to the nozzle 1 and relatively to the direction of motion F of the substrate. It should be noted that in the exemplified cases the installation is equipped with a vertically oriented nozzle, the surface of the substrate to be coated being horizontal. However, although this arrangement is performant, a variant may feature a horizontally oriented nozzle and a vertical substrate which moves in the upward direction since the liquid metal forms a meniscus between the substrate and the nozzle lips 3 under the effect of capillary forces.

As illustrated in FIG. 1, the pre-heated strip-substrate 4 passes over cylinder 14 which rotates at the strip velocity. This strip starts being cooled by its reverse side at the moment when molten metal deposits on its main side. Consequently, cooling of the molten liquid starts at the substrateliquid interface, which process reduces as much as possible the duration of when the substrate metal can dissolve into the liquid metal. This arrangement is important in the case of a thin substrate since on one hand the gap between the strip and the nozzle should remain constant and, on the other hand, the thermal inertia of the strip being very small as it is very thin, it is vital to cool the strip. It should however be firmly supported to prevent vibration and the faster cooling means are therefore provided by the support itself; this justifies the use of a rotatable support which constantly renews its cooling surface in contact with the strip and which can be cooled seperately before contacting another portion of the strip. The cylindrically shaped support is important because it enables to maintain the strip 4 under tension for ensuring good contact therewith, and preventing vibration of the strip and ensuring good heat transfer from the strip to the supporting cylinder 14.

After leaving the surface of the cylinder 14, the strip penetrates into the cooling duct in which a liquid is sprayed into a mist to complete cooling.

EXAMPLE 1

A 36% Ni-Fe alloy substrate is preheated to 650° C. and molten 99.99% pure Al is coated thereon at 850° C. Nozzle 1 is of graphite and feed-duct 2 is rectangular with a 0.7×1.1 mm cross-section; the main axis of this cross-section runs in a plane perpendicular to the drawing and length L' is 1.5 mm. The liquid metal is applied under a pressure of 200 mm of $H_2O$. Before cladding, the surface of the substrate is cleaned with trichloroethylene. The coating is performed under a 10% $H_2/N_2$ atmosphere and cooling is affected with water. The substrate displacement rate is 2 m/min.

The product has the following characteristics: The average thickness of the coating is 7 μm, maxima, 8 μm; the ruggedness between pits and humps is 0.5 μm. The thickness of the interfacial intermetallic compound layer is <0.2 μm. The hardness of the coating is 65 Vickers and the layer of aluminium covering the intermetallic layer comprises <1.5% of Ni and Fe.

EXAMPLE 2

This example is performed as disclosed in Example 1. The materials used, the operating conditions and the results are listed below:

Coating metal: 99.99% pure molton Al, temperature 920° C.
Substrate: 36% Ni-Fe alloy preheated to 600° C.
Nozzle: like in Example 1
Pressure on the liquid metal: 200 ml $H_2O$
Protective atmosphere and substrate preparation: like in Example 1
Substrate displacement rate: 6 m/min
Coating thickness: maximum 15 μm; average 12 μm; ruggedness 0.3 μm Intermetallic layer thickness <0.2 μm
Percent Fe+Ni in the main part of the coating: <1,5%
Coating hardness : 60 Vickers

EXAMPLE 3

The materials used and the operating conditions are listed below:

Coating metal: 99.99% pure Al, temperature 940° C.
Substrate: 76% Ni-Fe preheated to 550° C.
Nozzle: cross-section 0.7×5 mm; main axis in a plane perpendicular to the drawing, L' 2 mm
Pressure on the liquid metal: 100 mm $H_2$
Substrate pretreatment: alcaline scouring and picric acid pickling
Substrate cooling: water
Protective atmosphere: 10% $H_2/N_2$
Substrate displacement: 1.5 m/min
Coating thickness: maximum 5 μm; average 4 μm; ruggedness 0.1 μm
Intermetallic layer: <0.2 μm thick
Ni+Fe contact of the aluminium layer above the intermetallic layer: <1.5%
Coating hardness: 68 Vickers

EXAMPLE 4

The conditions and materials are the same as in the previous example except for the followings:

Substrate temperature: 500° C.
Molten Al temperature: 980° C.
Pressure on the liquid Al: 200 mm $H_2O$
Coating thickness: maximum 14 μm; average 12 μm; ruggedness 0.4 μm
Intermetallic layer: <0.2 μm
Purity of the Al in the remaining part of the coating: <1.5% of Ni+Fe
Coating hardness: 58 Vickers

EXAMPLE 5

Gold is deposited in this Example with the following parameters:

Coating metal: gold, temperature 1300° C.
Substrate: 42% Ni-Fe preheated to 600° C.
Pressure: 100 mm $H_2o$
Nozzle: graphite, cross-section 0.7×5 mm; main axis normal to the drawing; L'=1.4 mm
Substrate displacement: 4 m/min
Coating: average thickness 10 μm

EXAMPLE 6

The parameters pertaining to this Example are listed below:

Coating metal: Au molten at 1000° C.
Substrate: bronze, 2% Sn—9% Ni—Cu
Pressure: 100 mm $H_2O$
Nozzle: graphite; 0.5×5 mm cross-section; main axis normal to the drawing; L'=1 mm
Substrate displacement: 5 m/min
Coating: average thickness 5 μm

EXAMPLE 7

Copper is deposited under the following conditions:

Coating metal: molten Cu, 1200° C.; pressure 300 mm $H_2O$
Substrate: 42% Ni—Fe, 700° C.
Nozzle: graphite; cross-section 0.8×15 mm; main axis normal to the plane of drawing; L'=2 mm
Substrate displacement: 5 m/min
Coating: average thickness 40 μm

EXAMPLE 8

Coating metal: 63% Sn—Pb liquid solder at 450° C.; pressure 100 mm $H_2O$
Substrate: stainless steel (A-312), preheated to 250° C.
Nozzle: graphite; cross-section 0.7×2 mm; main axis normal to plane of drawing; L'=0.5 mm
Substrate displacement: 16 m/min
Coating: average thickness 10 μm

EXAMPLE 9

Coating metal: Ag liquid at 990° C.; pressure 200 mm $H_2O$
Substrate: Cu, preheated to 400° C.; displacement 8 m/min
Nozzle: graphite; cross-section of orifice 0.7×2 mm; main axis normal to plane of drawing; L'=2 mm
Coating average thickness: 20 μm

EXAMPLE 10

Copper is plated on Ni under the conditions below:
Coating metal: molten Cu, temperature 1200° C.; pressure 300 mm $H_2O$
Substrate: Ni, preheated to 800° C.; displacement rate 10 m/min
Nozzle: graphite; orifice of 0.7×12 mm; main axis oriented normally to the plane of the drawing; L'=2 mm
Coating average thickness: 40 μm

EXAMPLE 11

Silver is plated on nickel under the following conditions:
Coating metal: molten Ag at 1200° C.; pressure 200 mm $H_2O$
Substrate: Ni preheated to 700° C.; displaced 8 m/min
Nozzle: graphite; rectangulare orifice of 0.6×12 mm; main axis perpendicular to plane of drawing; L'=2 mm
Coating average thickness: 30 μm; no intermetallic layer

EXAMPLE 12

A gold alloy was plated on a nickel-iron substrate as follows:
Coating metal: 20% Si-Au, temperature 1000° C.
Substrate: 42% Ni-Fe, preheated to 600° C.; displacement 4 m/min
Nozzle: BN; rectangular orifice 0.7×5 mm; main axis perpendicular to the plane of drawing; L'=1.5 mm
Coating average thickness: 20 μm

EXAMPLE 13

Copper is deposited on tungsten as follows:
Coating metal: molten Cu, temperature 1200° C.; pressure 100 mm $H_2O$
Substrate: W preheated to 900° C., displacement 4 m/min
Nozzle: like in Example 12
Average coating thickness: 10 μm

EXAMPLE 14

Silver is plated on tungsten under the following conditions:
Coating metal: Ag heated to 1100° C.; pressure 100 mm $H_2O$
Substrate: W preheated to 800° C.; displacement 4 m/min
Nozzle: like in Example 12
Coating: 10 μm As specified, the process of the present invention is particularly applicable to the coating of integrated circuits lead frames. Hence, this process is convenient for coating the entire suface of the substrate for obtaining a laminated substrate; it is also convenient for partial coatings used in metallization processes or for making leads for soldering to chips or for binding the connecting leads of said chips on the supporting frames. These leads can be formed at any desired place of the substrate, e.g. on the center or on the edges. Naturally, the foregoing examples do not encompass all possible combinations, particularly with reference to laminates which can be obtained with a couple of different metals or alloys; the higher melting element of the couple is used as the base substrate and the other metal or alloy is deposited thereon according to the process of the invention to provide a laminate. The metals and alloys are selected from stainless steel, invar (Fe-42% Ni), Ni, Cu, Cu-Ni-Sn-P and W.

These laminates can be used, in turn, as substrates to be metallized for making metallized or soldering lanes for the connection of integrated circuits. These lanes can also be applied to non-laminated substrates.

The metallization lanes can be made of various metals of good electrical conductivity, e.g. Al, Cu, Ag, Ni, Au or alloys thereof.

The soldering lanes can be made of low melting solder, e.g. Sn-Pb, In, Pb-Sn-Ag or hard solder, e.g. Au with one or several of the following elements; Si, Ge, Sn, In. It is also possible to use, for soldering leads, metals like Ag or Cu or Ag-Cy alloyed with Pd or Au.

We claim:

1. Process for selectively forming at least one metal or alloy coating strip, 4 to 50 μm thick, on a substrate of another metal or alloy, the following being excluded: Al on 42% Ni-Fe or on Cu; 5% Sn-Pb or Al on 4% Sn-Cu, Cu or 5% Pb-Cu on stainless steel and 3.5 Sn-1.5 Ag-Pb on Ni, in which the melting point of the substrate is higher than that of the coating, the thickness of the interfacial intermetallic layer is between zero and 4 μm within a limit not exceeding 40% of the total coating thickness, the remainder of this coating being constituted of the coating metal or alloy having a purity between 97 and 99.5% by weight, characterized in that said substrate is heated to a temperature comprised between 0.6–0.95 times the melting temperature of the coating metal, the coating metal or alloy is melted at a temperature between its melting point temperature and twice that temperature, this molten metal or alloy is brought into contact with the substrate surface, which is displaced at a rate of 1–20 m/sec, under a pressure comprised between 50 and 500 mm $H_2O$, through a feed-pipe whose dimensions in the forward displacement direction of the substrate are comprised between 0.3 and 1.0 mm and whose output is at a fixed distance of 50 to 500 μm from the substrate surface, and the face delimited the output end of the feed-pipe in the direction of forward displacement of the substrate is prolonged of about 0.5 to 5 μmm.

2. Process for forming at least one coating strip on one face of a flexible band according to claim 1, characterized in that one sets the distance between the output orifice of the feed pipe and the substrate to a fixed value by displacing this substrate over a supporting member.

3. Process according to claim 2, characterized om that the reversed side of the substrate is contact cooled by transfer of heat to the surface of said support, said heat being dissipated afterwards.

4. Process according to claim 3, characterized in that said surface of the support is cylindrical and that it is rotated around a horizontal axis at a peripheral speed corresponding to the displacement of the substrate.

5. Process according to claim 3, characterized in that said substrate passes through a cooling fluid after leaving said support.

6. Process according to claim 1, characterized in that the fixed distance between the orifice of the feed-pipe outlet and the substrate is comprised between 150 and 200 μm.

7. Process according to claim 1, characterized in that said pipe is oriented substantially vertically an perpendicularly to said substrate.

* * * * *

UNITED STATES PATENT AND TRADEMARK OFFICE

CERTIFICATE OF CORRECTION

PATENT NO. : 4,865,876

DATED : September 12, 1989

INVENTOR(S) : HAOUR et al.

It is certified that error appears in the above-identified patent and that said Letters Patent is hereby corrected as shown below:

Column 8, line 53, please replace "1-20 m/sec" with --1-20 m/min--; and column 8, line 61, please replace "0.5 to 5 μmm" with --0.5 to 5 mm--.

Signed and Sealed this

Nineteenth Day of November, 1991

*Attest:*

HARRY F. MANBECK, JR.

*Attesting Officer*

*Commissioner of Patents and Trademarks*